US007654414B2

(12) United States Patent
Hiranaga et al.

(10) Patent No.: US 7,654,414 B2
(45) Date of Patent: Feb. 2, 2010

(54) LIQUIDS DISPENSING SYSTEMS AND METHODS

(75) Inventors: Hajime Hiranaga, Yawara-Mura (JP); Shuichi Tsuzuki, Ibaraki (JP); Tatsuya Hoshino, Ibaraki (JP)

(73) Assignee: Pall Corporation, Port Washington, NY (US)

( * ) Notice: Subject to any disclaimer, the term of this patent is extended or adjusted under 35 U.S.C. 154(b) by 633 days.

(21) Appl. No.: 10/503,810

(22) PCT Filed: Feb. 7, 2003

(86) PCT No.: PCT/US03/03518

§ 371 (c)(1),
(2), (4) Date: Apr. 29, 2005

(87) PCT Pub. No.: WO03/066509

PCT Pub. Date: Aug. 14, 2003

(65) Prior Publication Data

US 2005/0173458 A1 Aug. 11, 2005

Related U.S. Application Data

(60) Provisional application No. 60/354,301, filed on Feb. 7, 2002.

(51) Int. Cl.
*B67D 5/08* (2006.01)

(52) U.S. Cl. ..... 222/61; 222/52

(58) Field of Classification Search ..... 222/52, 222/61, 63, 189.06, 189.11, 372, 373, 1; 210/90, 96.1, 137, 143; 417/26, 53, 46, 395
See application file for complete search history.

(56) References Cited

U.S. PATENT DOCUMENTS

| | | | | |
|---|---|---|---|---|
| 4,910,369 | A * | 3/1990 | Rich | 210/90 |
| 4,917,576 | A | 4/1990 | Peschka et al. | |
| 5,102,010 | A | 4/1992 | Osgar et al. | |
| 5,134,962 | A * | 8/1992 | Amada et al. | 118/688 |
| 5,227,058 | A * | 7/1993 | Immonen et al. | 210/188 |
| 5,252,041 | A * | 10/1993 | Schumack | 417/395 |
| 5,262,068 | A | 11/1993 | Bowers et al. | |
| 5,490,765 | A * | 2/1996 | Bailey et al. | 417/2 |
| 5,772,899 | A | 6/1998 | Snodgrass et al. | |
| 6,168,048 | B1 | 1/2001 | Xu et al. | |
| 6,206,240 | B1 | 3/2001 | Osgar et al. | |
| 6,238,576 | B1 * | 5/2001 | Yajima | 210/767 |
| 6,245,148 | B1 * | 6/2001 | Liang et al. | 118/683 |

(Continued)

FOREIGN PATENT DOCUMENTS

JP 62-211920 A 9/1987

(Continued)

OTHER PUBLICATIONS

ATMI Packaging- Critical Materials Packaging Solutions, About Us, Products, BIB, BIC, BID, LAB; 9 pages.

*Primary Examiner*—Lien T Ngo
(74) *Attorney, Agent, or Firm*—Leydig, Voit & Mayer, Ltd.

(57) ABSTRACT

A liquid dispensing system (100) supplies a dispense liquid using a pump (101), wherein the system minimizes contamination of, and bubble formation in, the dispense liquid. The pressure at the suction side of the pump may be limited to a predetermined value.

28 Claims, 8 Drawing Sheets

U.S. PATENT DOCUMENTS 6,527,862 B2 * 3/2003 McLoughlin et al. ..... 118/313
7,029,238 B1 * 4/2006 Zagars et al. ..... 417/26

FOREIGN PATENT DOCUMENTS

JP 63-255576 A 10/1988
JP 04-122403 A 4/1992
JP 2000-109195 A 4/2000

* cited by examiner

LIQUIDS DISPENSING SYSTEMS AND METHODS

This application claims the benefit of priority of U.S. Provisional Application No. 60/354,301 filed on Feb. 7, 2002, which provisional application is incorporated by reference.

TECHNICAL FIELD

The present invention relates to arrangements, systems, and methods for dispensing liquids. More particularly, the invention relates to arrangements, systems, and methods for dispensing high purity liquids.

BACKGROUND OF THE INVENTION

In many industries, it is highly desirable to precisely dispense a very sensitive, high purity liquid in the course of manufacturing a product. For example, dispense liquids are commonly used in the microelectronics industry, such as the liquid crystal industry, the semiconductor industry, and the ink-jet printing industry, in the process of manufacturing a variety of products. An example of such a dispense liquid is a photoresist, which may be used in procedures such as photo lithography to produce an integrated circuit.

In these industries, the trend is to make parts, components, and products ever smaller. For example, circuit geometries have been reduced to the sub-micron size. At such a microscopic level, the introduction or formation of impurities in the dispense liquid is a major problem. Particulate contamination is a highly problematic impurity. Contamination of the dispense liquid with even the smallest of particles can ruin not only the dispense liquid, which can be extremely expensive, but also the products in an entire production run.

Bubbles in the dispense liquid is another problematic impurity. The formation of bubbles in the dispense liquid can be equally as devastating as particulate contamination. Dispense liquids typically include extremely volatile components, e.g., highly volatile solvents. These components can easily vaporize to form bubbles within the dispense liquid, for example, at the suction inlet of a dispense pump where the pressure can drop to a value which vaporizes the volatile components.

Another major problem associated with dispense liquids is their sensitive, fragile nature; they are easily damaged. Many processes utilize a periodic "shot" of dispense liquid rather than a continuous flow of liquid. Many conventional dispense pumps administer a "shot" by generating a high flow rate of the dispense liquid at high pressure for a short period of time. High pressures and high flow rates can adversely alter or change the properties of a dispense liquid, negatively affecting not only the dispense liquid but also the products made with the dispense liquid.

SUMMARY OF THE INVENTION

Embodiments of the present invention may address one or more of the previously described problems as well as many other problems associated with dispensing liquids.

In accordance with one aspect of the invention, a liquid dispensing system may comprise a feed assembly, a dispense pump, a feed line, a filter, a valve, and a controller. The feed assembly supplies a dispense liquid. The dispense pump has a suction inlet fluidly connected with the feed assembly. The dispense pump also has a dispense outlet for dispensing the dispense liquid to a dispense point. The feed line fluidly connects the feed assembly and the suction inlet of the dispense pump. The filter is positioned between the feed assembly and the dispense pump in the feed line, and the valve is positioned downstream from the feed assembly. The controller is arranged to detect an operating condition of the dispense pump and control the opening and closing of the valve. The controller is coupled to the valve to open the valve in response to a suctioning operation of the dispense pump at the suction inlet and drive the dispense liquid to the suction inlet to maintain the pressure at the suction inlet at or above a predetermined value.

In accordance with another aspect of the invention, a method for dispensing a dispense liquid may comprise operating a dispense pump having a suction inlet fluidly connected via a feed line to a feed assembly containing a dispense liquid, including drawing the dispense liquid into the suction inlet during a suctioning operation and further including dispensing the dispense liquid from a dispense outlet of the dispense pump to a dispense point. The dispensing method may further comprise filtering the dispense liquid through a filter in the feed line between the feed assembly and the suction inlet of the dispense pump. The dispensing method may further include operating a controller to detect an operating condition of the dispense pump and to open and close a valve in the feed line. Operating the controller includes opening the valve in response to a suctioning operation of the dispense pump at the suction inlet and driving the dispense liquid to the suction inlet to maintain the pressure at the suction inlet at or above a predetermined value.

Embodiments of the invention may include one or more of these aspects of the invention. Embodiments which supply dispense liquid to the suction inlet of a pump to prevent the pressure from falling below a predetermined value are highly advantageous. For example, by preventing the pressure from falling below a predetermined value, the formation of bubbles in the dispense liquid is minimized or prevented entirely. Preferably, embodiments of the present invention drive the dispense liquid to the suction inlet of a pump at a sufficient pressure or flow rate to prevent the pressure at the suction inlet of the pump from falling below the predetermined value when the dispense liquid is drawn into the pump. Embodiments which minimize or prevent formation of bubbles in the dispense liquid maintain the high purity of the dispense liquid, thereby improving the integrity and reliability of any process using the dispense liquid.

SPECIFIC DESCRIPTION OF THE INVENTION

Dispense liquids are frequently highly sophisticated mixtures containing volatile contaminants, e.g., volatile solvents, and the chemical and physical properties, such as viscosity and boiling point, may vary from one dispense liquid to another. Typical dispense liquids may include photoresists, dopants, solvents, acids, and bases. Embodiments of the present invention may be used to dispense any dispense liquid but are particularly useful in dispensing sensitive dispense liquids, i.e., dispense liquids that are capable of boiling or vaporizing to form gas bubbles at the suction inlet of a dispense pump at normal operational temperatures.

Figure 1:
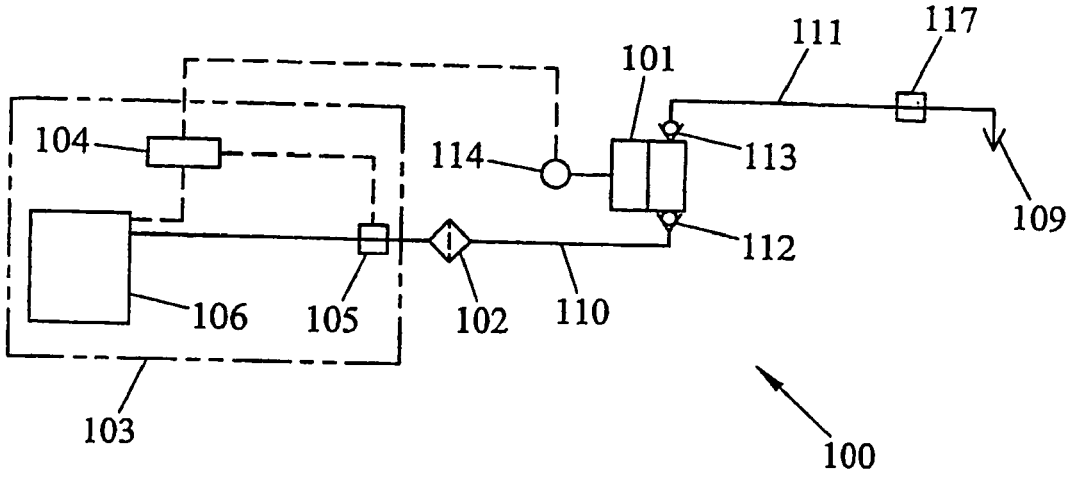
FIG. 1 is a diagram of a liquid dispensing system.

One embodiment of a liquid dispense system 100 is shown in FIG. 1. The liquid dispense system 100 may comprise a dispense pump 101, a filter 102, and a pressure compensation arrangement 103 that feeds a dispense liquid through the filter 102 to the dispense pump 101.

The dispense pump 101 may comprise any suitable pump assembly. For example, the pump may comprise a positive displacement pump, a diaphragm pump, a "shot" pump, or a continuous flow pump. However, any pump suitable for the particular application may be used, and the type of pump that may be used with this system is not limited to this list. Preferably the pump 101 is adapted to pump a precise amount of liquid. For example, if the pump is operating to dispense a "shot" of liquid, it may have both operational and non-operational stages. For example, when the pump 101 is operational it may draw in liquid from the feed line 110 into the suction inlet 112 and dispense the liquid through the dispense outlet 113 to the dispense line 111. When the pump is not drawing in liquid, it may be idle, on stand-by, shut off, or any other state wherein liquid is not passing through the dispense outlet 113.

The pump 101 may be any pump suitable for the particular demands of the production run or cycle. A typical cycle of a dispense system may endure for about 20 seconds. During the cycle, a typical dispense time may be approximately 2 seconds and a typical suction time may be approximately 4 seconds. Downtime for the system may then be approximately 14 seconds; during which time the system may be reloaded with a new substrate, e.g., a wafer, to replace the finished substrate. The pump 101 may, thus, be operational for about 6 seconds and on stand-by for about 14 seconds. Therefore, if the pump 101 is administering dispense liquid to a substrate, e.g., a wafer, approximately 3 wafers may be produced per minute. A typical shot of dispense liquid may range from about 0.5 cc or less to about 1.0 cc or more, depending on the application.

The pump 101 may be chosen based on many factors, including the desired flow rates for the cycle, the level of accuracy desired, and/or the type of dispense liquid. For example, it may be preferable that the pump 101 be capable of dispensing a low flow rate, e.g., a flow rate that does not produce a shear of the dispense liquid. The pump may be selected based on its ability to administer liquid in an accurate and precise amount. For example, because of the small size of the substrate, or wafer, and possibly the sensitivity of the liquid, fluctuations and/or inconsistencies between shots, during a cycle, or between production runs may be detrimental to the ultimate product. For example, the accuracy of the liquid dispensed through the pump 101 may have a margin of error of about +0.0005 cc/shot for a system dispensing at 0.5 cc/shot.

The pump 101 may have a suction inlet 112 and a dispense outlet 113. The suction inlet 112 may be in fluid communication with the filter 102 and the pressure compensation arrangement 103. The suction side of the pump 101 may decrease pressure in the feed line 110 to the pump 101 when the pump 101 is drawing dispense liquid into the suction inlet 112. The dispense outlet 113 may be in fluid communication with a dispense point 109, e.g., via the dispense line 111 and a valve 117 in the dispense line 111. The pump 101 may be driven by a motor 114 and may include a pump control unit which may coordinate the operation of the pump and dispense valve 117.

The filter 102 may comprise any filter suitable for filtering the particular dispense liquid. The filter 102 may comprise any suitable shape, material, or construction. The filter 102 may be disposable or cleanable. The filter 102 may be chosen based on the demands of the system or the particular cycle. For example, it may be chosen based on the desired flow rates, temperatures, and/or pressures. The filter 102 may also be any suitable filter for the type of dispense fluid, for example, based on the characteristics and/or properties of the dispense fluid, such as viscosity, vapor pressure, and specific gravity.

The filter 102 may comprise any suitable components, including one or more of a filter cartridge, a filter medium, support and drainage layers, end caps, a cage, a core, or a housing. The components of the filter 102 may comprise any suitable material compatible with the dispense liquid, such as plastics materials or metallic materials, and may have any desired shape, e.g., a generally cylindrical shape. In many preferred embodiments, the shape of the housing corresponds to the shape of the filter cartridge which is contained in the housing. The housing may comprise a single piece structure or a multi-piece structure.

A filter cartridge may comprise a filter element having a filter medium. The filter medium may comprise a solid or hollow porous mass, such as a cylindrical mass of sintered metal particles or a cylindrical mass of bonded and/or intertwined fibers, e.g., polymeric fibers. The filter medium may comprise a permeable sheet, e.g., a porous woven or non-woven sheet of fibers, including filaments, or a permeable or porous, supported or unsupported polymeric membrane. The filter medium may be pleated, e.g., may comprise radially extending or non-radially extending pleats, and may have a hollow cylindrical configuration. The filter may have any suitable pore rating including, for example, a pore rating in the range from about 0.02 micrometers or less to about 0.2 micrometers or more. Further, the filter medium may have a removal rating, for example, in the micro-filtration or nano-filtration ranges. The filter element may also comprise one or more of drainage layers, pre-filter layers, additional filter layers, substrates, and/or cushioning layers. The filter element may be disposed between a cage and a core, but alternatively, may comprise only one or neither of a cage and a core. The ends of the filter element, the cage, and/or the core may be sealed to end caps. One or both of the end caps may be open end caps.

Preferably, the filter 102 is suitable for flow rates through the filter in the range from about 0.1 cc/second or less to about 6 cc/second or more, more preferably from about 0.1 cc/second or less to about 3 cc/second or more. A suitable filter for use with the present system may be a filter with a low hold-up volume so that waste of the dispense fluid is minimized. An example of a suitable filter is one available from Pall Corporation under the trade designation EZD-2. For example, a suitable filter may comprise a housing, preferably having an interior fitted to minimize hold up volume and/or dead zones within the housing. An interior side wall of the housing and an exterior of a filter cartridge may be similarly shaped, and may define an annular fluid flow distribution channel between the interior of the housing and the exterior of the filter cartridge. Preferably, the annular channel is dimensioned to reduce hold up volume. An interior wall of the top portion of the housing may be spaced from a top portion of the filter cartridge and may be configured to allow gases or bubbles to rise from the annular flow distribution chamber and over the top of the filter cartridge. The interior wall of the top portion of the housing may comprise a sloped or inclined configuration, such as a space between the interior wall of the top portion of the housing and the top portion of the filter cartridge that may increase continuously away from the top of the filter cartridge. The top portion of the housing may be associated with a vent, for example. The housing may comprise a fluid conduit, such as a fluid inlet conduit, that may extend from a fitting at the top of the housing, such as an inlet, axially along an outer periphery of the filter cartridge and may open at the bottom of the housing, e.g., at the annular flow distribution channel. Further, an interior bottom wall of the housing and a bottom end cap of the filter cartridge may have mating shapes. The housing may comprise an outlet, for example, in fluid communication with a fluid outlet conduit. The outlet may be in fluid communication with an opening, for example, an opening in an end cap of the filter cartridge. Such a filter is shown in International Publication No. WO 01/95993, herein incorporated by reference.

The pressure compensation arrangement 103 preferably feeds sufficient dispense liquid through the filter 102 to the suction inlet 112 of the dispense pump 101 to prevent the pressure at the suction inlet 112 from falling below a predetermined value, e.g., a predetermined lower limit. The predetermined value of the pressure is preferably high enough to minimize or prevent the particular dispense liquid being drawn into the pump 101 from boiling or vaporizing to form gas bubbles at normal operational temperatures. Thus, the predetermined value may vary depending on such factors as the operational temperatures, which may be in the range from about 0° C. to about 60° C., and the chemical and physical properties of the dispense liquid, which may include boiling characteristics, viscosity, or susceptibility of the liquid to shear. For any given dispense liquid and dispense process, the predetermined value may be determined, for example, empirically. Further, in some instances the predetermined value may be set to a value suitable to protect several dispense liquids, including, for example, a class of dispense liquids, such as photoresists. For example, a predetermined value of −0.3 bar (gauge) is believed to be high enough to minimize or prevent any volatile components in many photoresists from boiling or vaporizing and forming bubbles at most normal operational temperatures.

The pressure compensation arrangement 103 is preferably arranged to feed dispense liquid at a sufficient pressure and/or flow rate to prevent the pressure at the suction inlet 112 from falling below the predetermined value. By driving the dispense liquid to the suction inlet 112 of the dispense pump 101, a relatively positive pressure is created that may compensate for or may balance the relatively negative pressure created when the pump 101 is drawing the dispense liquid into the suction inlet 112. The dispense liquid may be driven to the suction inlet 112 at any pressure and/or flow rate which prevents the pressure at the suction inlet 112 from falling below the predetermined value. However, in many preferred embodiments, the dispense liquid is not driven to the suction inlet 112 at a pressure or flow rate much higher than that which prevents the pressure from falling below the predetermined value. Depending on the sensitivity of the dispense liquid, pressures and/or flow rates that are too high may damage or adversely alter the properties of the dispense liquid.

The pressure compensation arrangement 103 may be configured in a wide variety of ways to feed sufficient dispense liquid to the suction inlet 112 of the dispense pump 101 to minimize or prevent the formation of bubbles. For example, the pressure compensation arrangement 103 may include a valve 105 in a feed line 110 to the filter 102 and the pump 101, a controller 104 coupled to the valve 105, and a feed assembly 106 supplying dispense liquid to the feed line 110.

A wide variety of valves are suitable. For example, the valve 105 may be a diaphragm valve, a needle valve, or a ball valve and may be operated electrically, pneumatically, or hydraulically. The valve 105 may be a variable flow valve, i.e., capable of providing varying dispense liquid flow rates. Preferably, the valve 105 is simply a binary on/off valve that opens to permit dispense liquid flow or closes to block dispense liquid flow. The valve 105 is preferably a fast-acting valve. For example, the valve may open or close in about 5 seconds or less or, more preferably, about 1 second or less or about 0.5 seconds or less or about 0.1 seconds or less. The valve 105 is preferably selected to minimize pressure drop and to avoid damage to the dispense liquid, e.g., to avoid shear damage as the dispense liquid flows through the valve 105. Further, the valve 105 is preferably composed of materials that do not react with the dispense liquid and are contaminant free. Suitable materials may include fluorocarbon materials, such as polytetrafluoroethylene (PTFE), perfluoroalkoxy (PFA), and polyolefin.

The valve 105 may be located in a variety of positions. For example, the valve 105 may be located in the feed line 110 between the filter 102 and the suction inlet 112 of the dispense pump 101 or at the suction inlet 112 of the dispense pump 101. Alternatively, the valve 105 may be located within the dispense pump 101 or within the filter 102 or within the feed assembly 106. Preferably, the valve 105 is located in the feed line 110 downstream of the feed assembly 106 and upstream of the filter 102.

The controller 104 may serve to ensure that when the pump suction inlet 112 of the dispense pump 101 draws dispense liquid into the dispense pump 101, there is a sufficient feed of dispense liquid to the suction inlet 112 to prevent the pressure of the suction inlet 112 from falling below the predetermined value. The controller 104 may be coupled to various components to communicate with the components, e.g., to receive or send information or commands. For example, the controller 104 is preferably coupled, directly or indirectly, to the valve 105 to open the valve 105 at any time suitable to prevent the pressure of the suction inlet 112 from falling below the predetermined value. The controller 104 may open the valve 105 before or after the dispense pump 101 begins drawing dispense liquid into the suction inlet 112. Preferably, the controller 104 opens the valve 105 near, e.g., at, the time the dispense pump 101 begins drawing dispense liquid into the suction inlet 112. The controller 104 may also serve to close the valve 105 when the dispense liquid feed is to be terminated. For example, the controller 104 may close the valve 105 before or after the dispense pump 101 stops drawing dispense liquid into the suction inlet 112. Preferably, the controller 104 closes the valve 105 near, e.g., at, the time the dispense pump 101 stops drawing dispense liquid into the suction inlet 112.

The controller 104 may also be coupled, for example, to the feed assembly 106 and may serve to regulate one or more functions of the feed assembly 106. For example, the controller 104 may regulate the pressure of the dispense liquid which is supplied from the feed assembly 106 into the feed line 110, or the controller 104 may monitor the amount of dispense liquid in the feed assembly 106 and provide a suitable signal when the dispense liquid level is low.

To maintain a suitable timing for opening and closing the valve 105 and/or regulating the feed assembly 106, the controller 104 may be coupled to a variety of other components. For example, the controller 104 may be coupled to the dispense pump 101, e.g., the motor 114, the pump control unit or any other component of the dispense pump 101, to determine when the valve 105 may be opened or closed. For example, the controller 104 may open or close the valve 105 in accordance with when the suction inlet 112 is going to begin drawing dispense liquid into the pump 101 or cease drawing dispense liquid into the pump 101. Alternatively or additionally, the controller 104 may be coupled to a component, such as a pressure sensor or a flow meter, in, e.g., the feed line 110, the filter 102, or the feed assembly 106 to determine when the valve 105 may be opened or closed, e.g., in accordance with when the pressure or the flow rate changes. As another alternative, the controller 104 and the pump 101 may be synchronized by a master controller, which monitors the entire dispense process, or the controller 104 may have a pre-set timing sequence which corresponds to the timing sequence of the dispense pump 101.

The controller 104 may be a pneumatic or hydraulic controller but is preferably an electronic device such as a microprocessor or an electronic circuit such as a logic array or a relay array. The controller 104 may be physically located, for example, with the feed assembly 106 and/or with the valve 105 or it may be a stand-alone component. The controller 104 may be associated with the dispense pump 101, e.g., as a separate component within the dispense pump 101 or as a portion of the dispense pump controller. Alternatively, the controller 104 may be part of a master controller.

The feed assembly 106 may serve as a source of the dispense liquid. For example, the feed assembly may include a container or a reservoir for the dispense liquid. Alternatively, the feed assembly 106 may include a supply line for the dispense liquid. For example, the feed assembly 106 may include one or more pumps which provide, e.g., circulate, the dispense liquid within a supply line. Preferably, the feed assembly 106 also includes a pressure source which drives the dispense liquid, e.g., along the feed line 110 through the filter 102, to the suction inlet 112 of the dispense pump 101 at a sufficient pressure and/or flow rate to prevent the pressure at the suction inlet 112 from falling below the predetermined value. The pressure source, which may be coupled to a reservoir or container of the dispense liquid, may be a pressurized gas source, a pump, a mechanical device such as an expressor, a gravity feed assembly, or any other arrangement which drives sufficient dispense liquid to the suction inlet 112. The pressure exerted by the pressure source on the dispense liquid to drive the dispense liquid to the suction inlet 112 may vary depending on factors such as the pressure drop, e.g., the pressure drop through the filter 102, and the chemical and physical properties of the dispense liquid, e.g., the viscosity of the dispense liquid or the susceptibility of the dispense liquid to shear. The desired pressure may be determined, for example, empirically, for any given process and dispense liquid. For many processes and dispense liquids, a pressurized gas may be applied directly or indirectly to the dispense liquid, for example, at a pressure from about 4 bars or less.

In a preferred mode of operation, the dispense pump 101 of the liquid dispense system 100 may draw dispense liquid into the suction inlet 112 of the pump 101 and may dispense the dispense liquid through the dispense outlet 113 along the dispense line 111 to the dispense point 109. The pressure compensation arrangement 103 preferably supplies sufficient dispense liquid to the suction inlet 112 of the dispense pump 101 to limit the pressure at the suction inlet 112 to a predetermined value, e.g., a predetermined lower limit value, which minimizes or prevents the formation of bubbles in the dispense liquid. For example, the controller 104 may sense that the dispense pump 101 is about to draw, or is drawing, dispense liquid into the suction inlet 112 and may open the valve 105. In many embodiments, the time at which the pump 101 begins or ceases drawing dispense liquid into the suction inlet 112 and the amount of time it takes the valve 105 to partially or fully open or close are principal factors in determining the timing of the commands from the controller 104 to the valve 105. For example, the controller 104 may issue an open signal to the valve 105 sufficiently before the pump 101 begins drawing dispense liquid into the suction inlet 112 to ensure that the valve 105 is at least partially open before dispense liquid begins flowing into the suction inlet 112.

Once the valve 105 is open, the feed assembly 106 supplies dispense liquid, for example, along the feed line 110 and through the filter 102, to the suction inlet 112 at a sufficient pressure and/or flow rate to prevent the pressure at the suction inlet 112 from falling below the predetermined value, thereby minimizing or preventing the formation of bubbles in the dispense liquid. Consequently, the dispense liquid reaches the dispense pump 101 in a highly pure state. For example, any impurities, such as particulates or gels, may be removed by the filter 102 and the formation of gas bubble impurities is minimized or prevented by the pressure compensation arrangement 103. The controller 104 may then sense that the dispense pump 101 is about to cease, or, more preferably has ceased, drawing dispense liquid into the suction inlet 112 and may close the valve 105, terminating the flow of dispense liquid to the dispense pump 101.

Figure 2:
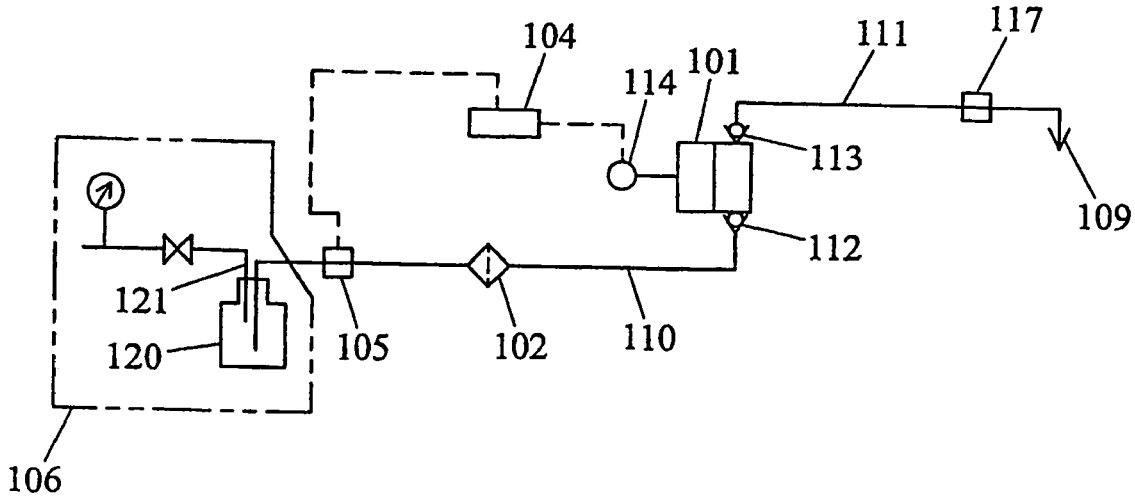
FIG. 2 is a diagram of another liquid dispensing system.

FIG. 2 illustrates an embodiment of a feed assembly 106. As shown, the feed assembly 106 may comprise a reservoir 120 and a pressurized gas source, e.g., a nitrogen feed 121. Dispense liquid may be held in the reservoir 120, and the reservoir 120 may be in fluid communication with the feed line 110. The reservoir 120 may comprise any suitable reservoir to hold the dispense liquid, e.g., to isolate the dispense liquid from the ambient environment, withstand the pressure of the nitrogen feed 121, and maintain the integrity and purity of the dispense liquid. The reservoir 120 may include any number of inlets and outlets that may be fitted with associated valves. The reservoir 120 may comprise a contaminant-free material, such as a polymeric material or a metallic material. For example, the reservoir 120 may comprise a fluorocarbon material, a polyolefin material, and/or a nylon material.

The dispense liquid may be supplied to the feed line 110 from the reservoir 120 by gas pressure, preferably nitrogen gas pressure. Thus, the nitrogen feed 121 is preferably in fluid communication with the reservoir 120. The nitrogen gas pressure may be applied to the interior of the reservoir 120 at a variable pressure, but preferably the nitrogen gas pressure is constant. More preferably, the nitrogen gas pressure is constant throughout a cycle of the system, and also may be constant for all cycles of the system for a given amount of dispense liquid. The flow of nitrogen gas into the reservoir may operate to displace the dispense liquid from the reservoir when the valve 105 is open. Preferably, the pressure of the nitrogen gas is in the range from about 0.1 bar or less to about 1 bar or more.

In the illustrated embodiment, the controller 104 may be coupled to the dispense pump 101 and may operate based on the operation of the pump 101. For example, the controller 104 may instruct the valve 105 to open when the pump 101 draws in dispense liquid through the suction inlet 112. As the valve 105 opens, dispense liquid flows through the valve 105 from the reservoir 120. Pressurized nitrogen gas flowing through the nitrogen feed 121 into the reservoir 120 may displace the dispense liquid and drive the dispense liquid from the reservoir 120 into the feed line 110 through valve 105 into the suction inlet 112 of the pump 101. The reservoir 120 and the nitrogen feed 121 of the feed assembly 106 of FIG. 2 supply dispense liquid to the suction side 112 of the dispense pump 101 at a sufficient pressure and/or flow rate to prevent the pressure at the suction side 112 of the dispense pump 101 from falling below the predetermined value. By driving the dispense liquid to the suction inlet 112 of the pump 101, a relatively positive pressure is created that may compensate for (or may balance) the relatively negative pressure created when the pump 101 is drawing the dispense liquid into the suction inlet 112. The controller 104 may close the valve 105 in accordance with the operation of the pump 101, for example, when the pump 101 ceases drawing dispense liquid into the suction inlet 112.

Figure 3:
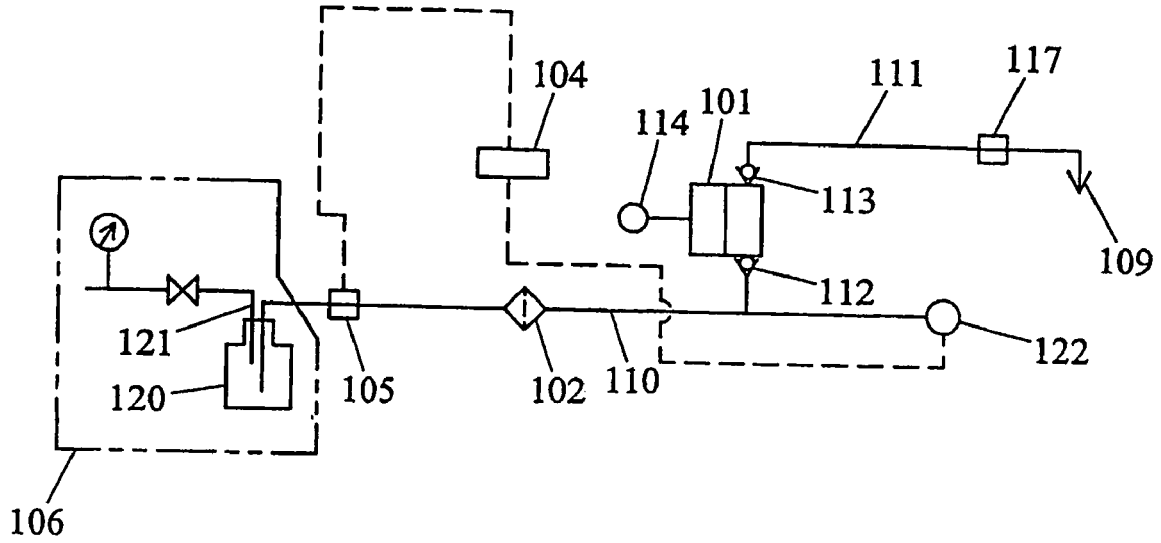
FIG. 3 is a diagram of another liquid dispensing system.

Another liquid dispense system is shown in FIG. 3. In the embodiment shown in FIG. 2, the controller 104 is coupled to the dispense pump 101 to sense the operation of the dispense pump 101. However, a dispense system may not be limited to these features. For example, as shown in FIG. 3, a pressure sensor 122 may be coupled to the controller 104 and may be in fluid communication with the suction inlet 112 of the pump 101, for example in the feed line 110. For example, the pressure sensor 122 may be positioned between the downstream side of the filter 102 and the suction inlet 112 of the pump 101. Further, the pressure sensor 122 may be positioned elsewhere as an alternative to the illustrated position. The system may include additional pressure sensors disposed in any suitable location, for example, pressure sensors may be positioned upstream of and downstream from the filter 102, e.g., to detect the pressure drop across the filter 102. While a pressure sensor is shown in the illustrated embodiment, any other component indicative of flow into the suction inlet 112 of the pump 101, e.g., a flow meter, may be used as an alternative or in addition to the pressure sensor 122. Alternatively, the controller 104 may be coupled to both the pressure sensor 122 and the motor 114.

The pressure sensor 122 may comprise any suitable pressure sensor, preferably a pressure sensor capable of quickly detecting a low pressure change. Preferably, the pressure sensor 122 is constructed of a contaminant-free material. Preferably, portions of the pressure sensor that may come into contact with the dispense liquid may comprise a fluorocarbon material.

As shown in FIG. 3, the controller 104 may open and close the valve 105 based on information obtained from the pressure sensor 122, e.g., the pressure at the suction inlet 112 of the pump 101. For example, the controller 104 may instruct the valve 105 to open once the pressure sensor 122 senses a drop in the pressure at the suction inlet 112 of the pump 101 as dispense liquid is drawn into the pump 101. The reservoir 120 and the nitrogen feed 121 of the feed assembly 106 of FIG. 3 supply dispense liquid to the suction side 112 of the dispense pump 101 at a sufficient pressure and/or flow rate to prevent the pressure at the suction side 112 of the dispense pump 101 from falling below the predetermined value, thereby preventing or minimizing the formation of bubbles in the dispense liquid. When the pump 101 ceases drawing dispense liquid into the suction inlet 112, the pressure sensor 122 may sense an increase in pressure at the suction inlet 112, which is communicated to the controller 104. The controller 104 may then close the valve 105. By providing feedback of the actual conditions on the suction inlet 112 of the pump 101, the system may react and compensate for the pressure more quickly.

Figure 4:
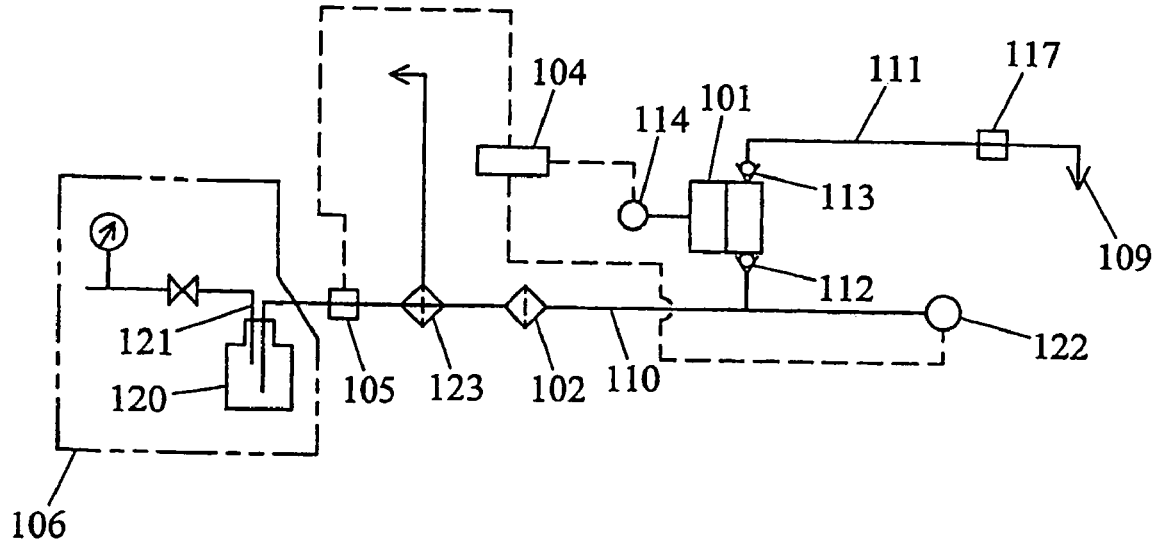
FIG. 4 is a diagram of another liquid dispensing system.

Another liquid dispense system is shown in FIG. 4. This system is illustrated as including all of the elements of FIG. 3. However, the controller 104 is coupled to both the motor 114 and the pressure sensor 122, and the system includes a degasser, such as a degassing module 123. The degassing module 123 is preferably coupled to a vacuum and may assist in eliminating bubbles in the dispense liquid, e.g., removing any dissolved nitrogen gas or other gases that may be present in the dispense liquid. While the degassing module 123 is illustrated as being positioned in the feed line 110 between the valve 105 and the filter 102, it may alternatively be positioned in any suitable location such as downstream of the filter 102. Further, more than one degassing module 123 may be used. The number of degassing modules 123 may depend on the demands of the system. The degassing module 123 may comprise any suitable degassing module adapted for the specific type of dispense liquid. For example, the degassing module 123 may comprise a hollow fiber cross flow module. A suitable degassing module is available from Pall Corporation under the trade designation INFUZOR.

The operation of the system shown in FIG. 4 may be similar to the operation of the system shown in FIG. 3. However, the driving pressure of the feed assembly 106 may be adjusted upward to account for the pressure drop through the degassing module 123 to ensure that the dispense liquid is driven to the suction inlet 112 at a sufficient pressure and/or flow rate to prevent the pressure at the suction side 112 of the dispense pump 101 from falling below the predetermined value, thereby preventing or minimizing the formation of bubbles in the dispense liquid.

Figure 5:
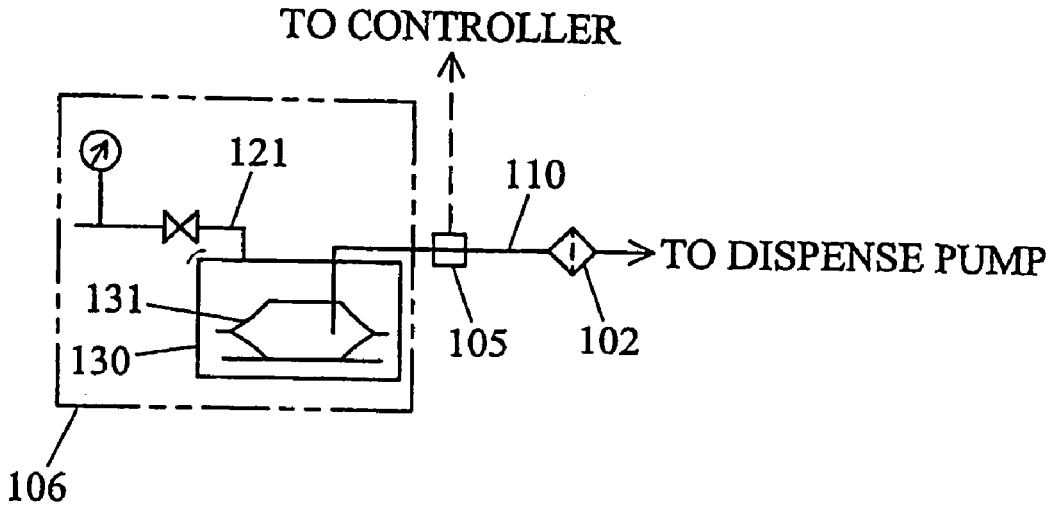
FIG. 5 is a diagram of another liquid dispensing system.

Another liquid dispense system is shown in FIG. 5. This system preferably includes many elements, such as a pump, a filter, and a pressure compensation arrangement, including a controller and a valve, which may have one or more of any of the features described with respect to the other embodiments. Further, the liquid dispense system may also include a pressure sensor and/or a degassing module (not shown), which may have one or more of any of the features described with respect to the other embodiments. However, in the system shown in FIG. 5, the feed assembly 106 may comprise a flexible fluids bag 131, which contains the dispense liquid, positioned in a pressure vessel 130. Further, the feed assembly 106 may comprise more than one flexible fluids bags 131 positioned in a pressure vessel 130. The flexible fluids bag 131 may isolate the dispense liquid from the nitrogen gas or any other gas present in or administered to the pressure vessel 130. Preferably the flexible fluids bag 131 comprises a material that is compatible with the dispense liquid and is contamination-free. The fluids bag 131 preferably comprises a plastics material, such as a fluorocarbon or polyethylene material.

The nitrogen feed 121 pressurizes the vessel 130 around the bag 131. When the valve 105 is opened, the flexible bag 131 collapses under the pressure of the nitrogen feed, driving the dispense liquid through the feed line 110. Again, the feed assembly 106 of FIG. 5 preferably supplies the dispense liquid to the suction inlet 112 of the dispense pump 101 at a sufficient pressure and/or flow rate to prevent the pressure at the suction inlet 112 of the dispense pump 101 from falling below a predetermined value.

Figure 6:
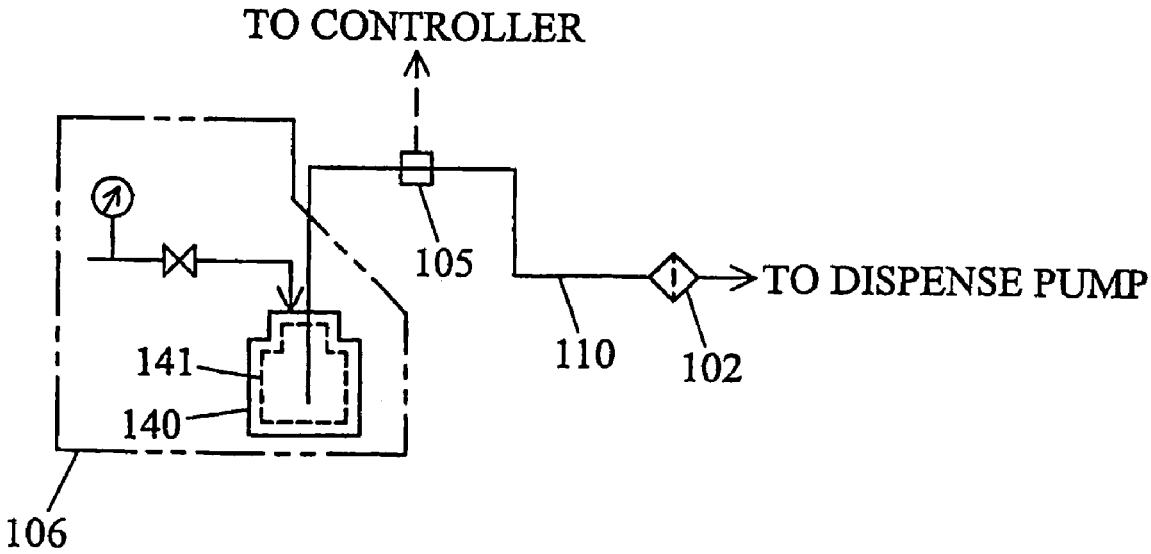
FIG. 6 is a diagram of another liquid dispensing system.

Another liquid dispense system is shown in FIG. 6. This system preferably includes many elements, such as a pump, a filter, and a pressure compensation arrangement, including a controller and a valve, which may have one or more of any of the features described with respect to the other embodiments, especially the embodiment shown in FIG. 5. Further, the liquid dispense system may also include a pressure sensor and/or a degassing module (not shown), which may have one or more of any of the features described with respect to the other embodiments. However, in the system shown in FIG. 6, the feed assembly 106 may comprise a fluids bag 141, which holds the dispense liquid, positioned in a pressure canister 140. The fluids bag 141 may isolate the dispense liquid from the nitrogen gas or any other gas present in or administered to the pressure canister 140. A suitable bag and canister arrangement may be available from ATMI Packaging under the trade designation NOWPAK.

The system shown in FIG. 6 operates similarly to the system shown in FIG. 5. For example, the nitrogen feed 121 shown in FIG. 6, pressurizes the canister 140 around the bag 141 and, when the valve is open, forces the dispense liquid into the feed line 110. The feed assembly 106 preferably supplies the dispense liquid to the suction inlet 112 of the dispense pump 101 at a sufficient pressure and/or flow rate to prevent the pressure at the suction inlet 112 of the dispense pump 101 from falling below the predetermined value, thereby preventing or minimizing the formation of bubbles in the dispense liquid.

Figure 7:
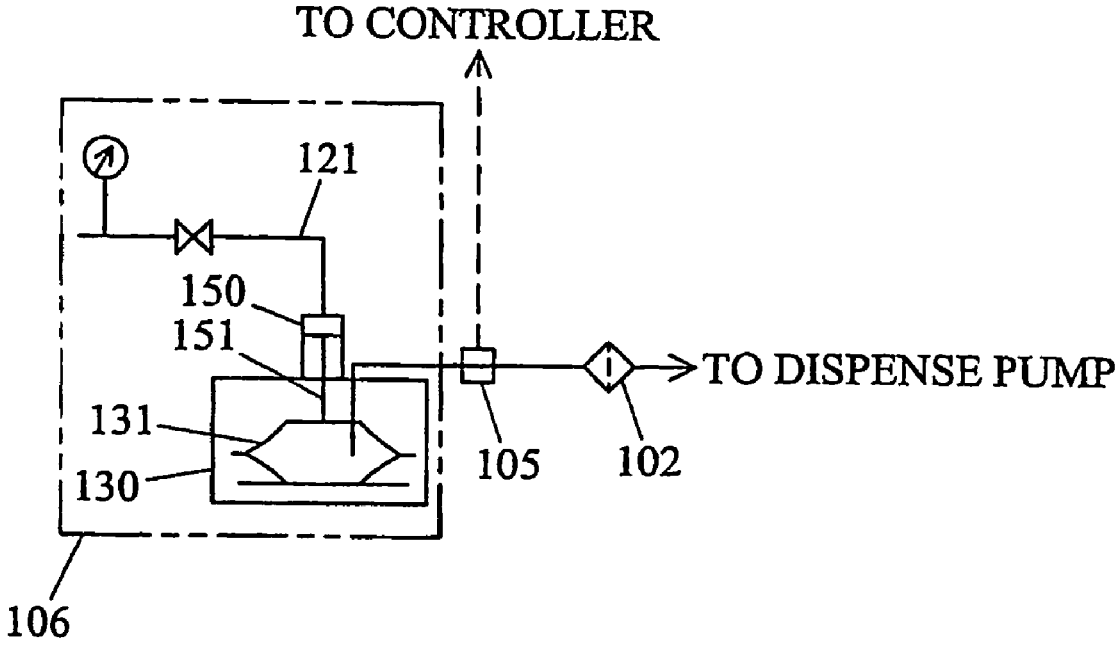
FIG. 7 is a diagram of another liquid dispensing system.

Another liquid dispense system is illustrated in FIG. 7. This system preferably includes many elements, such as a pump, a filter, and a pressure compensation arrangement, including a controller and a valve (not shown), which may have one or more of any of the features described with respect to the other embodiments, especially the embodiments shown in FIGS. 5 and 6. Further, the liquid dispense system may also include a pressure sensor and/or a degassing module (not shown), which may have one or more of any of the features described with respect to the other embodiments. However, the feed assembly 106 in FIG. 7 also includes an expressor, i.e., an apparatus which expresses the dispense liquid. For example, the feed assembly 106 may include a pneumatic expressor and the pneumatic expressor may include an air cylinder 150, which operates in conjunction with the nitrogen feed 121, to exert physical pressure on the fluids bag 131. The pneumatic expressor may include an extension or arm 151 that extends from the air cylinder 150, into the pressure vessel 130, to the exterior of the bag 131, and presses against the bag 131. Alternatively, the air cylinder 150 may be associated with a bag 141 and pressure canister 140, as shown in FIG. 6.

The operation of the system shown in FIG. 7 is similar to the operation of the other embodiments, especially the embodiments shown in FIGS. 5 and 6. The pressure of the nitrogen feed 121 on the air cylinder 150 forces the arm 151 against the bag 131 and drives the dispense liquid from the bag 131 when the valve 105 is open. The feed assembly of FIG. 7 preferably supplies the dispense liquid to the suction inlet 112 of the dispense pump 101 at a sufficient pressure and/or flow rate to prevent the pressure at the suction inlet 112 of the dispense pump 101 from falling below a predetermined value.

Figure 8:
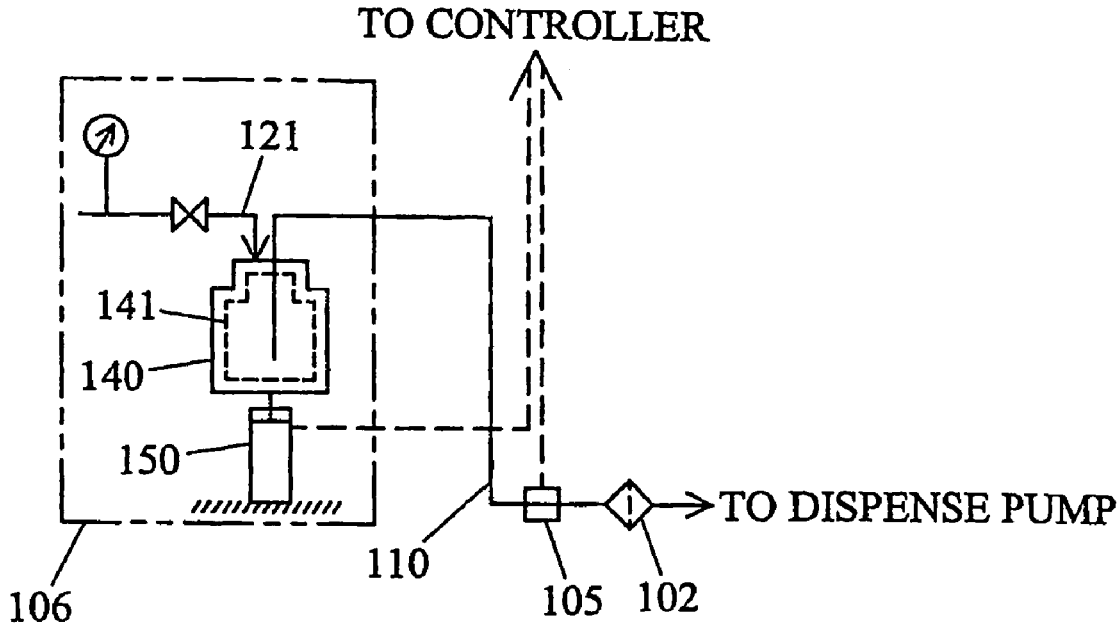
FIG. 8 is a diagram of another liquid dispensing system.

Another liquid dispense system is illustrated in FIG. 8. This system preferably includes many elements, such as a pump, a filter, and a pressure compensation arrangement, including a controller and a valve, which may have one or more of any of the features described with respect to the other embodiments. Further, the liquid dispense system may also include a pressure sensor and/or a degassing module (not shown), which may have one or more of any of the features described with respect to the other embodiments. However, the feed assembly 106 in FIG. 8 also includes a gravity feed assembly which may be used in conjunction with another pressure source, such as the nitrogen feed 121, or may be used alone. The gravity feed assembly may be variously configured. For example, it may include a pneumatic, hydraulic, or mechanical cylinder 150 coupled to the dispense liquid reservoir 140 to change the height of the reservoir 140 and the head pressure of the dispense liquid dispensed from the reservoir 140. In this embodiment, the suction inlet 112 of the dispense pump 101 is preferably arranged below the reservoir 140. Alternatively, the cylinder 150 may be associated with a bag 131 and a pressure vessel 130, as shown in FIG. 5. The gravity feed assembly may be coupled to the controller (not shown) to adjust the height of the reservoir 140. By increasing the height of the reservoir 140 in the vertical direction, the head pressure may be increased with respect to the suction inlet 112 of the pump 101. For example, by lifting the reservoir 140 about 1 meter in height, approximately 0.1 bar of positive head pressure is produced at the suction inlet 112. Additionally, the gravity feed assembly may be used to weigh the reservoir 140. For example, as the bag 141 empties, the gravity feed assembly may detect changes in the weight of the reservoir 140 and/or may determine when the bag 141 is empty.

In operation of the system shown in FIG. 8, the controller may adjust the height of the cylinder 150 which in turn adjusts the height of the reservoir 140 to provide a desired head pressure. This head pressure may be used alone or in conjunction with the nitrogen feed 121 to drive the dispense liquid to the suction inlet 112. Thus, the feed assembly of FIG. 7 preferably supplies the dispense liquid to the suction inlet 112 of the dispense pump 101 at a sufficient pressure and/or flow rate to prevent the pressure at the suction inlet 112 of the dispense pump 101 from falling below a predetermined value.

Figure 9:
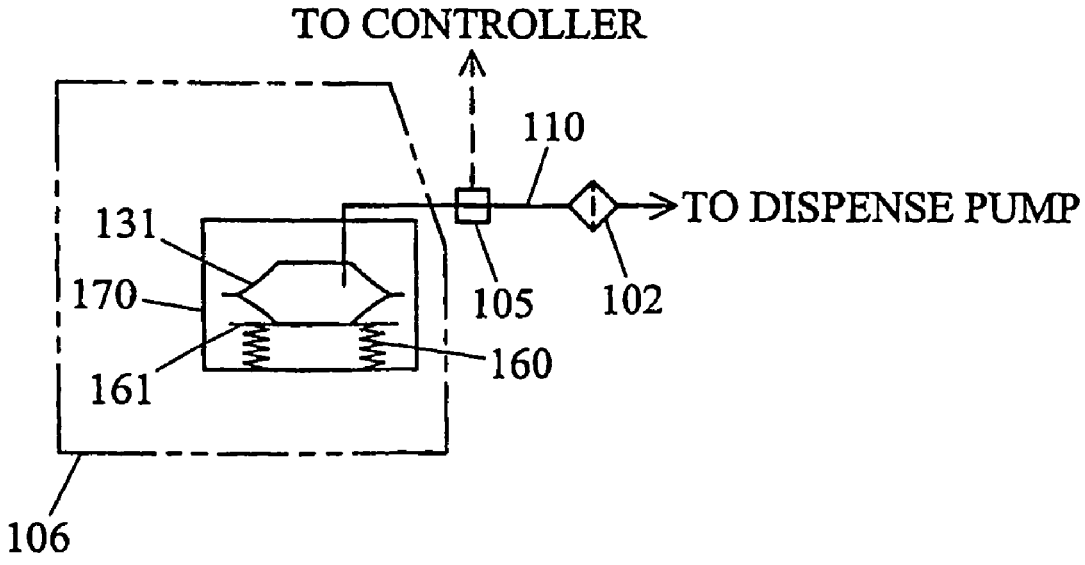
FIG. 9 is a diagram of another liquid dispensing system.

Another liquid dispense system is illustrated in FIG. 9. This system preferably includes many elements, such as a pump, a filter, and a pressure compensation arrangement, including a controller and a valve, which may have one or more of any of the features described with respect to the other embodiments. Further, the liquid dispense system may also include a pressure sensor and/or a degassing module (not shown), which may have one or more of any of the features described with respect to the other embodiments. However, the feed assembly 106 in FIG. 9 includes a mechanical expressor for driving the dispense fluid into the feed line 110. The mechanic expressor may be configured in a variety of ways. For example, the expressor may include hinged plates, between which a flexible bag is located. In the illustrated embodiment, the mechanical expressor comprises springs 160 positioned within the housing 170. The springs 160 contact a plate 161 which presses against the flexible fluids bag 131. The springs 160 may apply any desired force against the flexible fluids bag.

In operation, the mechanical expressor presses against the bag 131 and drives the dispense liquid into the feed line 110 when the valve 105 is opened by the controller. Preferably, the feed assembly of FIG. 9 supplies the dispense liquid to the suction inlet 112 of the dispense pump 101 at a sufficient pressure and/or flow rate to prevent the pressure at the suction inlet 112 of the dispense pump 101 from falling below a predetermined value.

Figure 10:
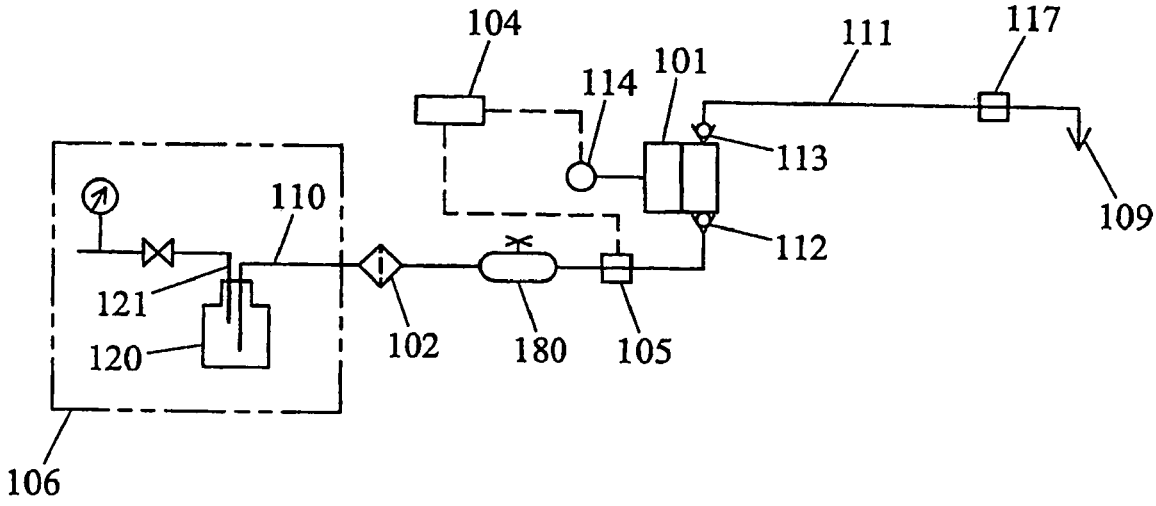
FIG. 10 is a diagram of another liquid dispensing system.

Another liquid dispense system is illustrated in FIG. 10. This system preferably includes many elements, such as a pump, a filter, and a pressure compensation arrangement, including a controller and a valve, which may have one or more of any of the features described with respect to the other embodiments. Further, the liquid dispense system may also include a pressure sensor and/or a degassing module (not shown), which may have one or more of any of the features described with respect to the other embodiments. However, the system in FIG. 10 includes one or more additional elements, e.g., an accumulator 180 for accumulating dispense liquid in the feed line 110. Further, as shown in FIG. 10, the valve 105 may be positioned downstream of the filter 102. The valve 105 is preferably positioned downstream of the accumulator 180 and near the suction inlet 112 of the dispense pump 101. It may be advantageous for the accumulator 180 and the valve 105 to be positioned in the feed line 110 near the suction inlet 112, for example, without any intervening components. However, this system may comprise any suitable arrangement, such as a filter 102 positioned downstream of the accumulator 180.

The accumulator 180 may have any suitable configuration. For example, the accumulator 180 may comprise a flexible, preferably elastic, container positioned on the interior of a more rigid protective container. The inner and outer containers may comprise coaxially arranged tubes. The inner tube may comprise an elastomeric or an elastic thermoplastic material and may be in fluid communication with the feed line 110. The outer tube may comprise a more rigid material and/or structure to protect the inner tube. The space between the inner and outer containers may be gas pressurized, for example, by nitrogen gas, but is preferably little pressurized. However, the size of the space is preferably sufficient to allow the inner tube to elastically expand as it accumulates dispense liquid.

In operation, when the valve 105 is closed, dispense liquid may be driven by nitrogen gas from the reservoir 120 through the feed line 110 and through the filter 102. The dispense liquid may then collect, or accumulate, in the accumulator 180, elastically expanding the inner container of the accumulator 180. When the valve 105 is opened, the walls of the elastic inner tube of the accumulator 180 may contract, quickly driving the dispense liquid from the accumulator 180 through the valve 105 to the suction inlet 112 of the pump 101. Preferably, the dispense liquid is supplied to the suction inlet 112 of the dispense pump 101 from the feed assembly 106 and the accumulator 180 at a sufficient pressure and/or flow rate to prevent the pressure at the suction inlet 112 of the dispense pump 101 from falling below a predetermined value.

An advantage of the system of FIG. 10 is that dispense liquid may accumulate downstream of the filter 102 and upstream of the valve 105 in the accumulator 180. Thus, when the valve 105 opens, filtered dispense liquid may be more quickly supplied from the accumulator 180 to the suction inlet 112 of the pump 101, especially if the accumulator 180 and the valve 105 are located near the suction inlet 112 without any intervening components. For example, by positioning the filter 102 upstream of the accumulator 180 (as shown in FIG. 10), filtered dispense liquid may be driven to the suction inlet 112 without any delay that may be caused by the filter.

Figure 11:
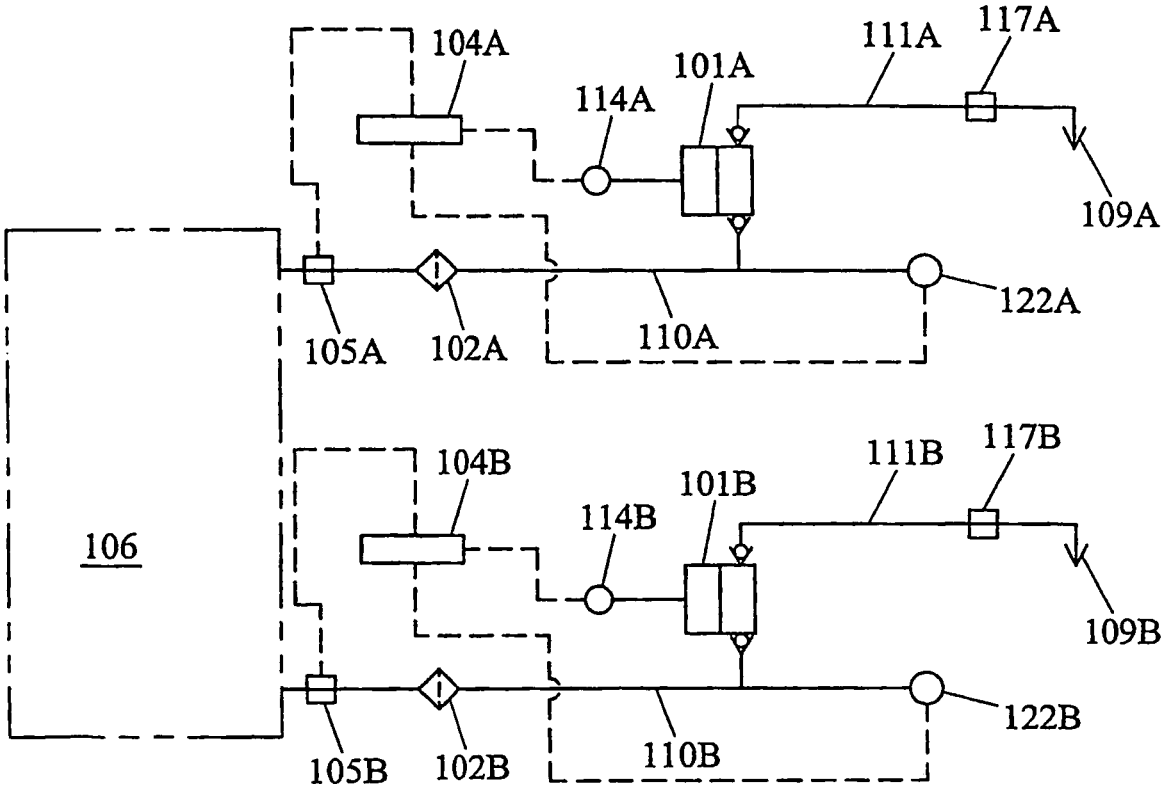
FIG. 11 is a diagram of another liquid dispensing system.

Another liquid dispensing system is illustrated in FIG. 11. This system preferably includes many elements, such as a pump, a filter, and a pressure compensation arrangement, including a controller and a valve, which may have one or more of any of the features described with respect to the other embodiments. Further, the liquid dispense system may also include a pressure sensor and/or a degassing module, which may have one or more of any of the features described with respect to the other embodiments. However, the feed assembly 106 may include a single reservoir which feeds two or more dispense pumps 101*a*, 101*b* along two or more feed lines 110*a*, 110*b*. Alternatively, the feed assembly 106 may include two or more reservoirs and one or more pressure sources which may feed two or more dispense pumps 101*a*, 101*b*. The operation of this assembly may be analogous to the operation of any of the other systems. In particular, the feed assembly 106 may be used to dispense the same dispense liquid to all of the dispense pumps, or different dispense liquids, for example having different properties to different dispense pumps 101*a*, 101*b*. For each dispense pump, the feed assembly 106 supplies the dispense liquid(s) to the suction inlet(s) 112*a*, 112*b* of the dispense pump(s) 101*a*, 101*b* at a sufficient pressure and/or flow rate to prevent the pressure at the suction inlet(s) 112*a*, 112*b* from falling below a predetermined value.

There are many advantages of the present systems. For example, the present systems provide accurate and repeated dispense of dispense liquids without contaminating the liquids with particulates and/or bubbles. The systems are not limited to a particular type of dispense liquid, but instead may be utilized to filter and dispense many different kinds of liquids, with varying viscosities, under relatively low pressure. Further, the systems may also decrease molecular shear on the liquids. Liquids may be filtered at a relatively low pressure and flow rate while being dispensed continuously or non-continuously with a dispense pump. Further, the present systems may minimize the occurrence of bubbles in the dispense liquid because, for example, they may provide automatic feedback control of different parameters of the system, for example, by monitoring pressure at the dispense pump suction point. In addition, while the systems may comprise two or more pumps, the systems may be used with only one pump. Using only one pump may result in a cheaper system of a smaller size.

EXAMPLE

Figure 12:
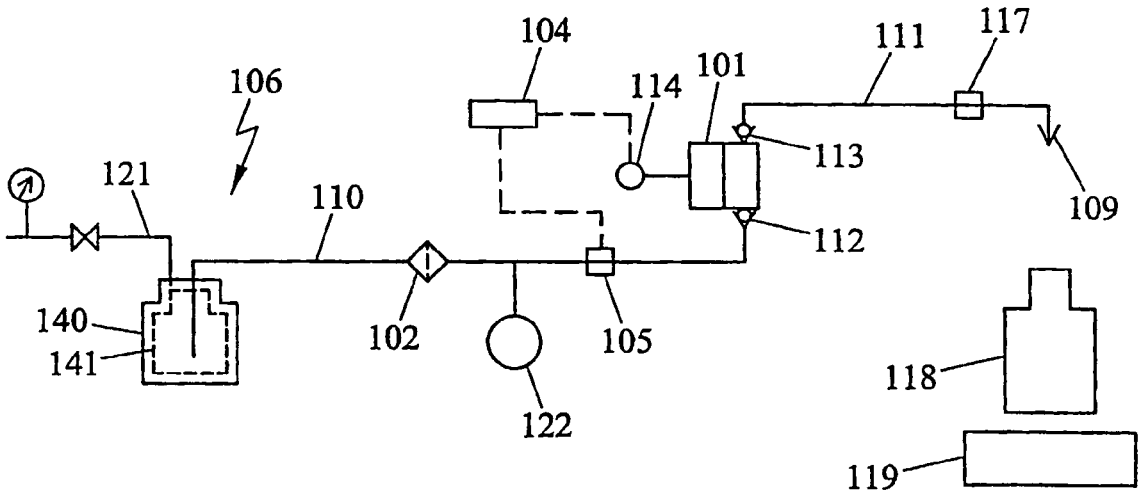
FIG. 12 is a diagram of another liquid dispensing system.

The test system shown in FIG. 12 dispenses isobutyl alcohol. The test system comprises a feed assembly 106 which includes a bag 141 of isobutyl alcohol in a pressure canister 140, such as the arrangement available from ATMI Packaging under the trade designation NOWPAK. The isobutyl alcohol has a viscosity of 4 mPa s at 20° C. The pressure canister is pressurized to 9.8 kpa by a nitrogen feed 121 and the isobutyl alcohol is discharged from the feed assembly 106 via a feed line 110. A filter 102 having a 0.05 micron rating, a pressure sensor 122 and an air-operated valve 105 are respectively positioned between the feed assembly 106 and the suction inlet 112 of a dispense pump 101. A controller 104 is coupled to the motor 114 of the dispense pump 101 and to the valve 105 in the feed line 110. The dispense outlet 113 of the dispense pump 101 fluidly communicates with a dispense point 109 via a dispense line 111 and an air operated valve 117 in the dispense line 111. A container 118 operatively associated with a balance 119 receives the isobutyl alcohol dispensed at the dispense point 109 and the balance 119 determines the dispense volume.

The dispense pump 101 is set at an intake rate of 0.4 mL/s into the suction inlet 112 and a dispense rate of 1.0 mL/s from the dispense outlet 113. The isobutyl alcohol is dispensed in twenty 20 s cycles. Within each cycle, isobutyl alcohol is taken into the suction inlet 112 of the dispense pump 101 for 3.75 s and the feed valve is opened for the duration of the intake, i.e., 3.75 s plus 0.65 seconds or 4.4 seconds. The results of the test are set forth in Table I.

TABLE I

| Cycle Number | Dispense volume |
|---|---|
| 1 | 1.782 |
| 2 | 1.783 |
| 3 | 1.783 |
| 4 | 1.783 |
| 5 | 1.783 |
| 6 | 1.783 |
| 7 | 1.783 |
| 8 | 1.783 |
| 9 | 1.783 |
| 10 | 1.783 |

TABLE I-continued

| Cycle Number | Dispense volume |
|---|---|
| 11 | 1.783 |
| 12 | 1.783 |
| 13 | 1.782 |
| 14 | 1.782 |
| 15 | 1.783 |
| 16 | 1.782 |
| 17 | 1.783 |
| 18 | 1.784 |
| 19 | 1.782 |
| 20 | 1.786 |
| Minimum | 1.782 |
| Maximum | 1.786 |
| Max. – Min. | 0.004 |
| Average | 1.782917706 |
| Standard Deviation | 0.000895492 |

Many of the advantages associated with systems and methods embodying one or more aspects of the invention are illustrated in these test results. For example, the remarkable consistency in the dispense volume from cycle to cycle indicates that there is no significant bubble contamination in the isobutyl alcohol.

While the invention has been described in some detail by way of illustration and example, it should be understood that the invention is susceptible to various modifications and alternative forms, and is not restricted to the specific embodiments set forth. One or more of the features of any of the embodiments may be combined with one or more of the features other embodiments. For example, the pressure sensor 122 of FIGS. 3 and 4 may be combined with the feed assemblies of, e.g., any of FIGS. 5-9 or 10 to provide feedback of the pressure at, for example, the suction side 112 of the pump 101. Pressure sensors may also be positioned upstream and downstream of any of the filters of any of the embodiments. An accumulator as in FIG. 10, for example, may be combined with any of the feed assemblies, for example, of FIGS. 5-9 or 11. A degassing module, for example, may be combined with any of the embodiments. Further, an embodiment may comprise all of a pressure sensor, an accumulator, and a degassing module, for example. A feed assembly of any one embodiment may be substituted for a feed assembly of another embodiment. For example, the feed assembly 106 of FIG. 7 may be substituted for the feed assembly 106 of FIG. 4, and the feed assembly 106 of FIG. 9 may be substituted for the feed assembly 106 of FIG. 2. Further, one or more of any of the features of any one embodiment may be modified or omitted. For example, the pressure sensor shown in FIGS. 3, 4, and 11 may be omitted. A flow meter, for example, may instead be used. Further, the pressure source of the feed assembly shown in FIGS. 2-4, for example, may be omitted and replaced, for example, by a pump or a pump assembly. In addition, as shown in FIG. 10, the valve 105 may be positioned downstream of the filter 102 in any other embodiment, for example, downstream of the filter 102 in, e.g., FIG. 2, 3, or 4. Further, valves may be positioned both upstream and downstream of the filter, for example. Thus, the described and illustrated embodiments are not intended to limit the invention but, on the contrary, the intention is to cover all modifications, equivalents, and alternatives falling within the spirit and scope of the invention defined in each of the following claims.

All of the references cited herein, including publications, patents, and patent applications, are hereby incorporated in their entireties by reference.

What is claimed is:

1. A system for use in dispensing a dispense liquid comprising:

a feed assembly for supplying a dispense liquid;

a dispense pump having a suction inlet fluidly connected with the feed assembly and a dispense outlet for dispensing the dispense liquid to a dispense point;

a feed line fluidly connecting the feed assembly and the dispense pump;

a filter disposed between the feed assembly and the dispense pump in the feed line;

a valve disposed downstream from the feed assembly; and a controller arranged to detect an operating condition of the dispense pump and control the opening and closing of the valve, wherein the controller is coupled to the valve to open the valve in response to a suctioning operation of the dispense pump at the suction inlet and drive the dispense liquid to the suction inlet to maintain the pressure at the suction inlet at or above a predetermined value.

2. The liquid dispensing system according to claim 1, further comprising a pressure sensor positioned on the downstream side of the filter.

3. The liquid dispensing system according to claim 2, wherein the controller receives signals from the pressure sensor.

4. The liquid dispensing system according to claim 1, wherein the valve is disposed between the feed assembly and the filter in the feed line.

5. The liquid dispensing system according to claim 1, wherein the valve is disposed between the filter and the dispense pump in the feed line.

6. The liquid dispensing system according to claim 1, wherein the feed assembly includes a reservoir, and wherein the reservoir comprises a pressure vessel or a pressure canister.

7. The liquid dispensing system according to claim 1, further comprising a pressure source for applying a pressure to the feed assembly, wherein a pressure of the pressure source discharges the dispense liquid held in the feed assembly into the feed line.

8. The liquid dispensing system according to claim 1, further comprising a pressure source for applying a pressure to the feed assembly, wherein the feed assembly includes a fluids bag which contains a dispense liquid, and a pressure of the pressure source collapses the fluids bag and discharges the dispense liquid in the fluids bag into the feed line.

9. The liquid dispensing system according to claim 1, further comprising an accumulator positioned downstream of the filter.

10. The liquid dispensing system according to claim 9, wherein the valve is located in the feed line between the accumulator and the suction inlet of the pump.

11. The liquid dispensing system according to claim 1, wherein the controller closes the valve according to a termination of the suctioning operation of the dispense pump.

12. The liquid dispensing system according to claim 1, wherein the dispense pump is a cyclic pump that draws a dispense liquid into the suction inlet during the suctioning operation over a portion of each cycle and ceases drawing the dispense liquid into the suction inlet upon termination of the suctioning operation.

13. The liquid dispensing system according to claim 1 wherein the valve is positioned in the feed line.

14. The liquid dispensing system according to claim 1, wherein the open valve supplies dispense liquid to the suction inlet of the dispense pump at a pressure or flow rate that prevents the pressure at the suction inlet from falling below the predetermined value during the suctioning operation.

15. The liquid dispensing system according to claim 1, wherein the feed assembly includes a pressure source arranged to drive dispense liquid to the suction side of the pump, the pressure source comprising a pressurized gas source.

16. The liquid dispensing system according to claim 1, wherein the feed assembly includes a pressure source arranged to drive dispense liquid to the suction side of the dispense pump, the pressure source comprising an expressor.

17. The liquid dispensing system according to claim 1, further comprising a degassing module, the degassing module being in fluid communication with the suction side of the pump.

18. The liquid dispensing system according to claim 1, wherein the pump comprises a positive displacement pump.

19. The liquid dispensing system according to claim 1, wherein the pump comprises a diaphragm pump.

20. The liquid dispensing system according to claim 9, wherein the accumulator is positioned in the feed line downstream of the filter.

21. A method of dispensing a dispense liquid comprising:

operating a dispense pump having a suction inlet fluidly connected via a feed line to a feed assembly containing a dispense liquid, including drawing the dispense liquid into the suction inlet during a suctioning operation and further including dispensing a dispense liquid from a dispense outlet of the dispense pump to a dispense point;

filtering the dispense liquid through a filter in the feed line between the feed assembly and the suction inlet of the dispense pump; and operating a controller to detect an operating condition of the dispense pump and to open and close a valve in the feed line, including opening the valve in response to a suctioning operation of the dispense pump at the suction inlet and driving the dispense liquid to the suction inlet to maintain the pressure at the suction inlet at or above a predetermined value.

22. A method according to claim 21 wherein driving the dispense liquid includes applying a pressure to the feed assembly to supply the dispense liquid to the suction inlet at a pressure or flow rate which prevents the pressure at the suction inlet from falling below the predetermined value.

23. A method according to claim 21 wherein driving the dispense liquid includes applying a pressure to a fluids bag containing the dispense liquid and discharging the dispense liquid from the fluids bag into the feed line.

24. The method of dispensing liquid according to claim 21, wherein driving dispense liquid to the suction inlet of the dispense pump includes driving dispense liquid to the suction inlet of the dispense pump before the dispense pump draws in dispense liquid through the suction inlet.

25. The method of dispensing liquid according to claim 21, wherein driving dispense liquid to the suction inlet of the dispense pump includes driving dispense liquid to the suction inlet of the dispense pump at the same time or after the dispense pump draws in dispense liquid through the suction inlet.

26. The method of dispensing liquid according to claim 21, wherein driving the dispense liquid to the suction inlet of the dispense pump includes supplying dispense liquid to the suction inlet of the dispense pump at a pressure or flow rate that prevents the pressure at the suction inlet from falling below the predetermined value during the suctioning operation.

27. The method of dispensing liquid according to claim 21, wherein driving the dispense liquid to the suction inlet of the dispense pump includes passing the dispense liquid through a degasser.

28. The method of dispensing liquid according to claim 21, wherein driving the dispense liquid to the suction inlet of the dispense pump includes passing the dispense liquid into an accumulator.

* * * * *